US007905989B2

(12) United States Patent
Scherb et al.

(10) Patent No.: US 7,905,989 B2
(45) Date of Patent: Mar. 15, 2011

(54) PROCESS AND APPARATUS FOR PRODUCING A TISSUE WEB

(75) Inventors: Thomas Scherb, Sao Paulo (BR); Luiz Carlos Silva, Campo Limp (BR); Danilo Oyakawa, Sao Paulo (BR); Rogerio Berardi, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/481,236

(22) Filed: Jun. 9, 2009

(65) Prior Publication Data

US 2009/0242158 A1 Oct. 1, 2009

Related U.S. Application Data

(62) Division of application No. 11/527,248, filed on Sep. 26, 2006, now Pat. No. 7,582,187.

(30) Foreign Application Priority Data

Sep. 30, 2005 (DE) ..... 10 2005 046 903

(51) Int. Cl.
*B31C 11/00* (2006.01)

(52) U.S. Cl. ..... 162/283; 162/358.3; 162/281; 162/363; 162/900; 34/114; 34/452

(58) Field of Classification Search ..... 162/283, 162/358.3, 112, 281, 363, 900–902; 34/114, 34/452

See application file for complete search history.

(56) References Cited

U.S. PATENT DOCUMENTS

| | | | | |
|---|---|---|---|---|
| 6,187,137 | B1 | 2/2001 | Druecke et al. | |
| 6,669,818 | B2 | 12/2003 | Lindén | |
| 6,921,460 | B2 | 7/2005 | Hermans et al. | |
| 2004/0173333 | A1 * | 9/2004 | Hermans et al. | 162/358.1 |
| 2005/0167066 | A1 | 8/2005 | Herman et al. | |
| 2007/0074837 | A1 * | 4/2007 | Scherb et al. | 162/205 |

* cited by examiner

*Primary Examiner* — Mark Halpern
(74) *Attorney, Agent, or Firm* — Taylor IP

(57) ABSTRACT

An apparatus for producing a fibrous web includes: a circulating permeable structured belt defining a sheet forming zone in which the fibrous web is formed; a circulating unstructured permeable supporting belt; a pressing section through which the fibrous web is led lying between the circulating permeable structured belt and the circulating unstructured permeable supporting belt; a Yankee cylinder having a surface and defining a press nip and a press nip region, wherein the fibrous web is led together with the structured belt through said press nip, the fibrous web in the region of the press nip being transferred from the structured belt to the surface of the Yankee cylinder; at least one doctor which doctors off the surface of the Yankee cylinder continuously; and a coating device which recoats the surface of the Yankee cylinder so that a renewed coating material is always present in the press nip.

26 Claims, 2 Drawing Sheets

PROCESS AND APPARATUS FOR PRODUCING A TISSUE WEB

CROSS REFERENCE TO RELATED APPLICATIONS

This is a division of U.S. patent application Ser. No. 11/527,248, entitled "PROCESS AND APPARATUS FOR PRODUCING A TISSUE WEB", filed Sep. 26, 2006 now U.S. Pat. No. 7,582,187, which is incorporated herein by reference.

BACKGROUND OF THE INVENTION

1. Field of the Invention

The invention relates to a process and an apparatus for producing a fibrous web, in particular a tissue web.

2. Description of the Related Art

Tissue paper ideally has high absorbency or a high water absorption capacity in conjunction with a high tear resistance. The absorbency and the water absorption capacity are determined substantially by the volume and porosity of the tissue paper.

In order to increase the volume, it has already been proposed to press the tissue paper web only zonally during its production, in order, in addition to the pressed regions of higher tear resistance, and to obtain more lightly pressed or unpressed more voluminous regions.

During the production of tissue paper, in a last drying step, the tissue web is led over the circumferential surface of a heated Yankee drying cylinder, before the finished product is creped off the latter. While the tissue web is being led over the Yankee drying cylinder, it is held by a fabric.

In particular during the production of tissue paper with voluminous regions which have been compressed only slightly during the dewatering, there is, however, the problem that the tissue paper comes into contact with the hot circumferential surface of the Yankee drying cylinder with an excessively low dryness. This problem occurs to a greater extent at high machine running speeds, since here the dewatering times are reduced further and the voluminous regions accordingly carry still more moisture with them.

On account of the excessively low dryness, during contact of the tissue web with the heated circumferential surface of the Yankee drying cylinder, water vapor is produced between the hot circumferential surface and the tissue web, which can lead to the web lifting off the roll circumferential surface.

As a result of the tissue web lifting off the roll circumferential surface, it is possible for problems to occur with account to the runnability, up to breaking of the tissue web.

Furthermore, on account of the formation of water vapor between the tissue web and the heated circumferential surface of the Yankee drying cylinder, it is possible for the formation of bubbles and holes in the tissue web to occur.

It is already known to coat the drying or Yankee cylinder in order to counter the problems occurring during a transfer of the fibrous web from a TAD (through air drying) fabric to the surface of the Yankees cylinder. In addition, a doctor arrangement has already been proposed in which a doctor crepes the fibrous web and doctors it off the Yankee cylinder, and at least one further doctor is provided for the purpose of removing a layer of the roll coating containing dirt.

At present, there exist two different processes for producing tissue paper. Firstly, there is the conventional tissue production process, in which the fibrous web is formed, pressed and dried on the Yankee cylinder. Secondly, there is what is known as the TAD production process (TAD=through air drying), in which the fibrous web is dried between the sheet forming zone and the press section by way of an air stream. This method is associated with a high paper quality.

To address the aforementioned problems, various parameters, in particular those which relate to the region of the Yankee cylinder, must be chosen in a suitable way.

Typical values for some known parameters are listed in the following table:

TABLE 1

| | Quantity of roll coating material mg/m$^2$; mL/min | Blade or doctor loading kN/m |
|---|---|---|
| Conventional tissue machine | 1-3; | ~2.5 |
| | 15-25 | 2-3 |
| TAD machines | 5-15; | ~7.0 |
| | 80-100 | 6-7 |

The high quantity of coating material previously required to coat the Yankee cylinder is obviously associated with economic disadvantages. The same applies to the relatively high blade or doctor loading previously required.

What is needed in the art is an improved process and an improved apparatus of the type mentioned at the beginning. What is needed in the art is an improved process and an improved apparatus which ensures the highest possible quality of the tissue paper and, at the same time, ensures that this high product quality can also be achieved with a lower quantity of coating material for the Yankee cylinder and a lower blade or doctor loading.

SUMMARY OF THE INVENTION

The present invention provides a process for producing a fibrous web, in particular a tissue web, having the following steps:

a) in a pressing zone, the fibrous web is pressed lying between the structured belt and a circulating, unstructured permeable supporting belt, b) the fibrous web and the structured belt are fed to a press nip provided on a Yankee cylinder, c) the fibrous web is transferred from the structured belt to the surface of the Yankee cylinder in the region of the press nip, d) the surface of the Yankee cylinder is doctored off continuously and then recoated again, so that a renewed coating is always present in the press nip.

With this process according to the invention, a high quality of the tissue paper is achieved with, at the same time, a reduced required quantity of coating material for the Yankee drying cylinder and reduced blade or doctor loading. The fact that optimal results can be achieved in particular even with a reduced quantity of coating material and reduced doctor loading can be attributed to various factors.

After the fibrous web has been pressed in the pressing zone, lying between the structured belt and a circulating unstructured, that is to say relatively smooth, permeable supporting belt, the tissue web can be brought into contact with the Yankee drying cylinder with a relatively smooth side, while on the other hand, on account of the structured belt lying on the other side of the web, only part of the fibrous or tissue web is pressed. In a departure from the conventional TAD machines, the tissue web can therefore come into contact with the Yankee cylinder with approximately 100% of the surface of the relevant side, while only part thereof is pressed.

During the pressing of the fibrous web in the pressing zone between the structured belt and the circulating unstructured, that is to say relatively smooth, permeable supporting belt, the fibrous web is dewatered in the direction of the permeable supporting belt. In this case, the pressing pressure is preferably 1.5 bar or less.

Because the fibrous web is dewatered further toward the side facing away from the structured belt through the supporting and/or dewatering belt, the fibers are forced in the direction of the relatively flat or smooth surface of the supporting belt, formed in particular by a dewatering belt. The dewatering can be carried out for example by way of an appropriately high vacuum and/or mechanically, for example by way of a tensioning belt, by way of which the structured belt, the fibrous web and the supporting belt are pressed against a preferably smooth surface. According to the invention, the relevant gas stream therefore flows firstly through the permeable structured belt, then the fibrous web and finally the permeable supporting belt. By contrast, in the case of a conventional TAD process, the relevant gas stream flows firstly through the fibrous web and then the structured belt. In such a conventional TAD process the fibrous web is therefore not given a smooth surface. Apart from this, the differential pressure produced in the conventional TAD process is relatively low.

According to the present invention, the coating of the Yankee cylinder additionally ensures improved transfer of the fibrous web from the structured belt to the surface of the Yankee cylinder. By way of the coating, the heat transfer from the Yankee cylinder to the fibrous web is improved considerably. In addition, bubble formation, lifting of the web and so on are counteracted. Since at least part of the coating has been removed continuously again by way of the relevant doctor, no dirt can accumulate.

For optimal support of the aforementioned transfer of the fibrous web from the supporting belt to the surface of the tissue cylinder, an adhesive coating material is applied to the surface of the Yankee cylinder.

According to another embodiment of the present invention, the quantity of material applied continuously to the surface of the Yankee cylinder preferably lies in a range from about 3 to about 9 $mg/m^2$.

In order to doctor off the surface of the Yankee cylinder continuously, a doctor or the like is loaded in such a way that the result is a line force in a range from about 3 to about 7 kN/m, preferably in a range from about 5 to about 6 kN/m. The relevant doctor loading can thus be reduced considerably without any kind of costs in terms of quality.

The fibrous web is formed on a circulating permeable structure belt, as a result of which the depressions of the structured belt are filled up with fibers, instead of the fibers of a web already formed being sucked into the depressions of the structured belt in a conventional TAD process. In this way, a voluminous fibrous web is produced as compared with the process in which a smoothly formed fibrous web is pressed into the depressions of a structured belt. Furthermore, as a result of forming the fibrous web between the permeable structured belt and a smooth unstructured forming fabric, the effect brought about by the dewatering of the fibrous web in the pressing zone in the direction of the supporting belt is further intensified such that approximately 100% of the surface of the relevant side of the fibrous web can come into contact with the Yankee cylinder.

As already mentioned, the pressing zone is expediently delimited on the side adjacent to the supporting belt by an at least substantially smooth surface. In this case, this smooth surface can in particular be formed by a rotating roll.

In the region of the pressing zone, a gas stream can be produced which flows through the structured belt, the fibrous web and the supporting belt, the gas stream flowing first through the structured belt, then the fibrous web and finally the supporting belt.

The gas stream that is produced can in particular be an air stream and/or steam stream.

According to another embodiment of the present invention, the gas stream is at least partly produced by way of a suction zone of a rotating suction roll, which delimits the pressing zone on the side adjacent to the supporting belt.

However, the gas stream can also at least partly be produced by way of a flat or curved suction box or the like, which delimits the pressing zone on the side adjacent to the supporting belt.

Furthermore, the gas stream can be produced at least partly by way of a positive pressure hood arranged on the side of the permeable structured belt. The positive pressure hood can be, for example, a steam blower box.

Alternatively or additionally, the structured belt, the fibrous web and the supporting belt can also be pressed against an at least substantially smooth surface by way of a press belt under tension. In this case, the smooth surface can in particular again be formed by a rotating roll.

The structured belt used is expediently a structured fabric.

The structured belt used can also be a (TAD) fabric, for example.

The fibrous web is formed in a way as has been described previously. However, in specific cases it may also be expedient to form the fibrous web by the fibrous stock suspension being sucked into the structure of the permeable structured belt by way of a vacuum device.

The supporting belt, as already mentioned, can in particular be a dewatering belt.

The relatively depressed and the relatively elevated regions of the structured belt are formed and arranged relative to one another in such a way that at most 35% and preferably at most 25% of the structured belt is pressed in the press nip. The gentlest possible pressing is achieved by the press nip provided on the Yankee cylinder being a shoe press nip. If the fibrous web to be produced does not require any bulk but does have a high dryness with a high production output, as an alternative to this the press nip formed on the Yankee cylinder can be formed with a suction press roll or a press roll.

According to another embodiment of the present invention, the Yankee cylinder is assigned only one doctor, by way of which, firstly, at least part of the coating is removed and, secondly, the fibrous web is creped and lifted off the cylinder surface.

According to another embodiment of the present invention, the Yankee cylinder is assigned a first doctor for removing at least part of the coating and a second doctor, by means of which the fibrous web is creped and lifted off the cylinder surface.

The outlet pocket between fibrous web and structured belt, occurring at the outlet from the press nip, is acted on by way of an air knife.

According to another embodiment of the present invention, in the region in which the structured belt runs off a mating roll forming the press nip with the Yankee cylinder, the outlet pocket between the structured belt and the mating roll is acted on by way of an air knife. As a result, fibers situated in the depressions of the structured belt are released, which assists the transfer of the fibrous web on the Yankee cylinder. In addition, the formation of bubbles on the fibrous web is counteracted.

The fibrous web removed from the Yankee cylinder again is subsequently wound up.

According to the present invention, an apparatus for producing a fibrous web, in particular a tissue web, includes a sheet forming zone, in which the fibrous web is formed on a circulating permeable structured belt, a pressing zone, through which the fibrous web is led lying between the structured belt and a circulating unstructured permeable supporting belt, and a press nip provided on a Yankee cylinder, through which the fibrous web is led together with the structured belt, the fibrous web in the region of the press nip being transferred from the structured belt to the surface of the Yankee cylinder, at least one doctor, which doctors off the surface of the Yankee cylinder continuously, and a coating device, by way of which the Yankee cylinder is subsequently recoated again, so that a renewed roll coating is always present in the press nip.

The coating device is driven or regulated in such a way that the quantity of coating material applied continuously to the surface of the Yankee cylinder lies in the range from about 3 to about 9 $mg/m^2$.

A doctor is provided to scrape off the surface of the Yankee cylinder continuously and to crepe the fibrous web, this doctor being loaded in such a way that the result is a line force in a range from about 3 to about 7 kN/m, preferably in a range from about 5 to about 6 kN/m.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
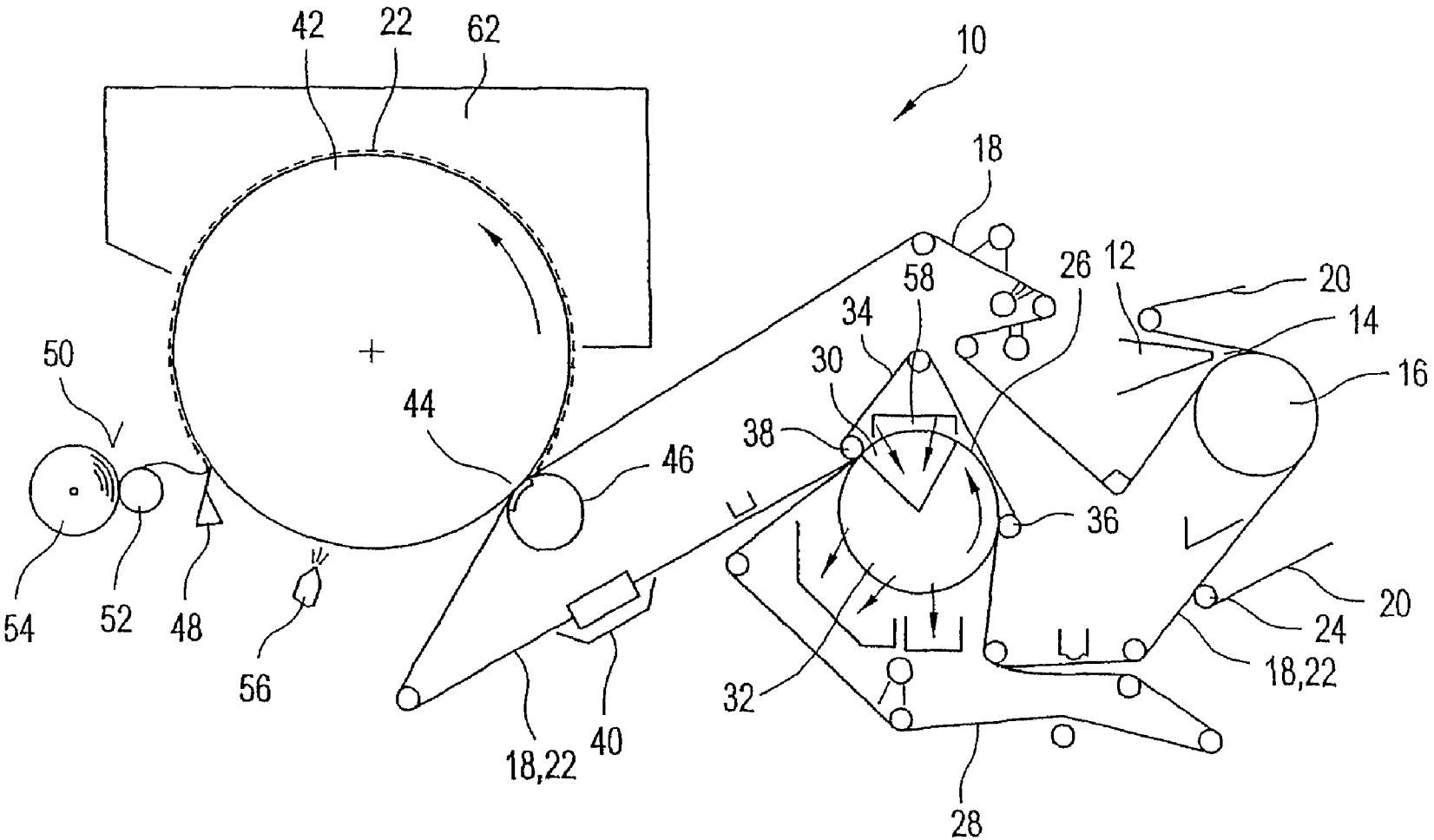
FIG. 1 is a schematic illustration of an embodiment of an apparatus for producing a fibrous web, in particular a tissue web.

Referring now to the drawings, and more particularly to FIG. 1, there is shown a schematic illustration of an embodiment of an apparatus 10 for producing a fibrous web, which is a tissue web in the present case.

A headbox 12 delivers a stock suspension jet into an inlet gap 14, which is formed in the region of a forming roll 16 between an inner circulating permeable structured belt 18 and an outer circulating forming fabric 20, which run together in the region of the forming roll 16 and are subsequently led jointly around this forming roll 16.

The structured belt 18 can be in particular a three-dimensionally structured fabric.

Facing the tissue web 22, the forming fabric 20 has a side that is relatively smooth as compared with the relevant side of the structured belt 18.

In contrast, the side of the structured belt 18 facing the tissue web 22 has depressed regions and regions elevated with respect thereto, the tissue web 22 being formed in these depressed and elevated regions of the structured belt 18.

The structured belt 18 can be formed by a TAD fabric, for example.

In the region of the forming roll 16, the tissue web 22 is dewatered substantially through the outer forming fabric 20. Then, in the region of a deflection roll 24, the forming fabric 20 is separated from the tissue web 22 again which, together with the structured belt 18, is led further to a pressing zone 26, in which the tissue web 22 is pressed lying between the structured belt 18 and a circulating unstructured permeable supporting belt 28.

The permeable supporting belt 28 can in particular be a felt. In the region of the pressing zone 26, pressure is exerted on the structured belt 18, the tissue web 22 and the supporting belt 28, the tissue web 22 being dewatered in the direction of the supporting belt 28 formed, for example, by a felt.

Since the tissue web 22 is dewatered in the direction of the permeable supporting belt 28 in the pressing zone 26, and the structured belt 18 led through this pressing zone 26 is identical with the structured belt on which the tissue web 22 was formed, the more voluminous sections of the tissue web 22 are compressed less highly than the less voluminous sections, so that, as a result, the voluminous structure of the relevant more voluminous sections is maintained.

The dewatering pressure for the tissue web 22 in the pressing zone 26 is produced simultaneously, at least in some sections, by a gas stream and by a mechanical pressing force.

The gas stream flows firstly through the structured belt 18, then the tissue web 22 and finally the permeable supporting belt 28.

As can be seen from FIG. 1, the gas stream is produced by a suction zone 30 of a suction roll 32.

The mechanical force applied alternatively or additionally is produced by the structured belt 18, the tissue web 22 and the supporting belt 28 in the pressing zone 26 being led between a press belt 34 under tension and a smooth surface, which is formed here by the roll 32, for example.

The pressing zone 26 is at least substantially defined by the wrap region of the press belt 34 around the circumferential surface of the suction roll 32, this wrap region being defined by the distance between the two deflection rolls 36, 38.

In the region 40 through which the tissue web 22 is led together with the structured belt 18, the tissue web 22 can be subjected to at least one further drying step.

Following that, the tissue web 22 is led together with the structured belt 18 through a press nip 44 formed on a drying cylinder, specifically a Yankee cylinder 42. In this press nip 44 the tissue web 22 lies between the structured belt 18 and the smooth surface of the Yankee cylinder 42. The press nip 44 is formed by a shoe press nip. The Yankee cylinder 42 is therefore assigned a shoe press unit, here a shoe press roll 46, in order to form the press nip 44. As can be seen from FIG. 1, a hood 62 can be assigned to the Yankee cylinder 42.

The fact that the tissue web has been formed between the structured belt 18 and a forming fabric 20 which is relatively smooth in relation thereto, means only the side of the tissue web 22 formed on the structured belt 18 has an undulating surface. By contrast, the surface of the tissue web 22 formed on the smooth forming fabric 20 is relatively smooth. The tissue web 22 now comes with this smooth side into contact with the surface of the Yankee cylinder 42 in the press nip 44. The tissue web 22 therefore touches the Yankee cylinder with a relatively large area. Since the structured belt 18 in the press nip 44 is identical with the structured belt on which the tissue web 22 was formed, it is moreover ensured that the more voluminous regions of the tissue web 22 are also virtually not pressed in this press nip 44. On the other hand, the less voluminous regions of the tissue web 22 are pressed, which means that the strength of the tissue web 22 is increased further.

Following the press nip 44, the structured belt 18 is separated from the tissue web 22, which is led on the Yankee cylinder 42 as far as a doctor 48, by which the tissue web 42 is creped and lifted off the Yankee cylinder 42. The tissue web 22 is subsequently fed to a reeler 50, in which it is wound up with the aid of a pressure roll 52 to form a roll 54.

Therefore, in the region of the press nip 44, the tissue web 22 is transferred from the structured belt 18 to the surface of the Yankee cylinder 42. The surface of the Yankee cylinder 42 is doctored off continuously, for example by way of the doctor 48, and is subsequently recoated again by way of a coating device 56, so that a renewed coating is always present in the press nip 44. An adhesive coating material can be applied to the surface of the Yankee cylinder 42.

The quantity of coating material applied continuously to the surface of the Yankee cylinder 42 expediently lies in a range from about 3 to about 9 mg/m$^2$. In order to doctor off the surface of the Yankee cylinder 42 continuously, a doctor or the like, here for example the doctor 48 simultaneously creping the tissue web, can be loaded in such a way that the result is a line force in a range from about 3 to about 7 kN/m, preferably in a range from about 5 to about 6 kN/m.

The gas stream that is produced which, in the pressing zone 26, flows firstly through the structured belt 18, then the tissue web 22 and finally the supporting belt 28, can in particular be an air stream and/or steam stream.

Alternatively or additionally to the suction roll 32, the gas stream can in particular be produced at least partly by way of a positive pressure hood 58 arranged on the side of the permeable structured belt 18.

As already mentioned, the structured belt 18 used can in particular be a structured fabric, for example a TAD fabric.

The supporting belt 28 provided can in particular be a dewatering belt, as already mentioned.

The relatively depressed and the relatively elevated regions of the structured belt 18 are preferably formed and arranged relative to one another in such a way that at most 35% and preferably at most 25% of the structured belt 18 is pressed in the press nip 44 formed with the Yankee cylinder 42.

Figure 2:
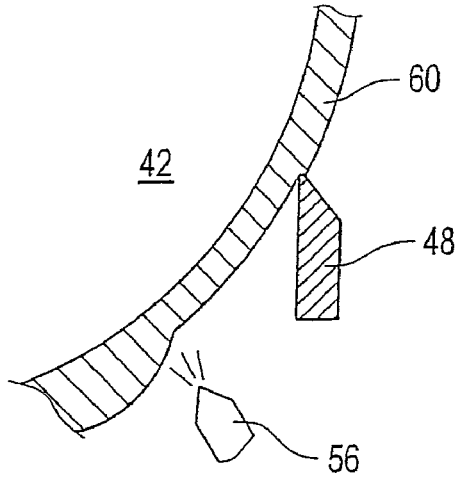
FIG. 2 is a fragmentary, side view of the Yankee cylinder with an associated coating device and a doctor, by way of which at least part of the coating applied is removed again continuously.

FIG. 2 shows an enlarged illustration of a section of the Yankee cylinder 42, to which the coating device 56 and a doctor 48 are assigned, by way of which at least part of the coating 60 applied is removed again continuously.

Figure 3:
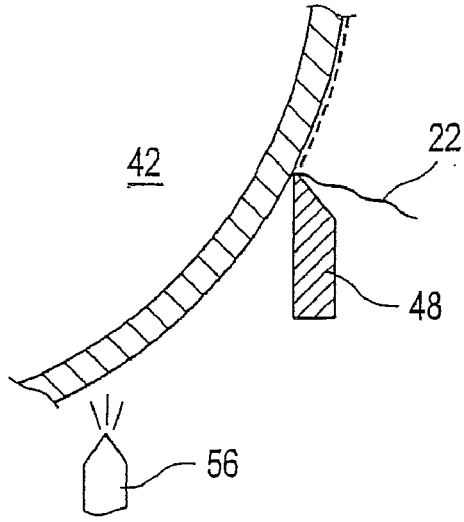
FIG. 3 is a fragmentary, side view, comparable with FIG. 2, of the Yankee cylinder with a single associated doctor, by way of which, firstly, the surface of the Yankee cylinder is doctored off and at least part of the coating applied is removed again, and by way of which, secondly, the tissue web is creped and lifted off the Yankee cylinder.

FIG. 3 shows a schematic partial illustration, comparable with FIG. 2, of the Yankee cylinder 42 having a single associated doctor 48, by way of which, firstly, the surface of the Yankee cylinder 42 is doctored off and at least part of the coating applied is removed again, and by way of which, secondly, the tissue web 22 is creped and lifted off the Yankee cylinder 42.

In FIG. 3, the coating unit 56 assigned to the Yankee cylinder 42 can be seen.

Figure 4:
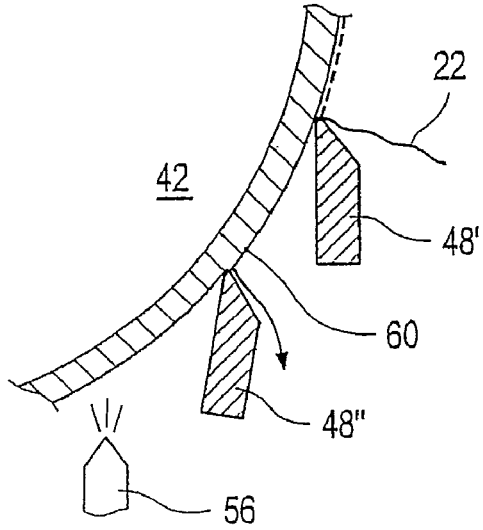
FIG. 4 is a fragmentary, side view, comparable with FIG. 3, of the Yankee cylinder, but the Yankee cylinder being assigned two doctors.

FIG. 4 shows a schematic partial illustration, comparable with FIG. 3, of the Yankee cylinder 42 with associated coating unit 56. However, the Yankee cylinder 42 is assigned two doctors 48', 48". The first doctor 48' serves to crepe the fibrous web 22 and lift it off the cylinder surface. By way of the second doctor 48", at least part of the coating 60 is removed, including dirt which has accumulated on the cylinder surface.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claim.

List of designations

| | |
|---|---|
| 10 | Apparatus |
| 12 | Headbox |
| 14 | Inlet gap |
| 16 | Forming roll |
| 18 | Structured belt |
| 20 | Forming fabric |
| 22 | Tissue web |
| 24 | Deflection roll |
| 26 | Pressing zone |
| 28 | Supporting belt |
| 30 | Suction zone |
| 32 | Suction roll |
| 34 | Press belt |
| 36 | Deflection roll |
| 38 | Deflection roll |
| 40 | Region |
| 42 | Yankee cylinder |
| 44 | Press nip |
| 46 | Shoe press roll |
| 48 | Doctor |
| 48' | Doctor |
| 48" | Doctor |
| 50 | Reeler |
| 52 | Pressure roll |
| 54 | Roll |
| 56 | Coating device |
| 58 | Positive pressure hood |
| 60 | Coating |
| 62 | Hood |

What is claimed is:

1. An apparatus for producing a fibrous web, said apparatus comprising:

a circulating permeable structured belt defining a sheet forming zone in which the fibrous web is formed;

a circulating unstructured permeable supporting belt;

a pressing section through which the fibrous web is led lying between said circulating permeable structured belt and said circulating unstructured permeable supporting belt;

a Yankee cylinder having a surface and defining a press nip and a press nip region, wherein the fibrous web is led together with said structured belt through said press nip, the fibrous web in said region of said press nip being transferred from said structured belt to said surface of said Yankee cylinder;

at least one doctor which doctors off said surface of said Yankee cylinder continuously;

a coating device which recoats said surface of said Yankee cylinder so that a renewed coating material is always present in said press nip; and an air knife, said press nip being further defined by an outlet and an outlet pocket occurring at said outlet, said air knife acting on said outlet pocket between the fibrous web and said structured belt.

2. The apparatus of claim 1, wherein said coating device applies an adhesive coating material to said surface of said Yankee cylinder.

3. The apparatus of claim 1, wherein said coating device is driven or regulated in such a way that a quantity of said coating material applied continuously to said surface of said Yankee cylinder lies in a range from about 3 to about 9 $mg/m^2$.

4. The apparatus of claim 1, wherein said at least one doctor scrapes off said surface of said Yankee cylinder continuously, said at least one doctor loaded in such a way that results in a line force in a range from about 3 to about 7 kN/m.

5. The apparatus of claim 4, wherein said at least one doctor is loaded in such a way that results in said line force being in a range from about 5 to about 6 kN/m.

6. The apparatus of claim 1, wherein said pressing section includes a side adjacent to said supporting belt and includes an at least substantially smooth surface, said pressing section delimited on said side by said at least substantially smooth surface.

7. The apparatus of claim 6, further comprising a rotating roll, said rotating roll comprising said at least substantially smooth surface.

8. The apparatus of claim 6, further comprising a press belt, wherein said structured belt, the fibrous web, and said supporting belt are pressed against said at least substantially smooth surface by said press belt under tension.

9. The apparatus of claim 8, further comprising a rotating roll, said rotating roll comprising said at least substantially smooth surface.

10. The apparatus of claim 1, including a gas stream generator in a region a region of said pressing section for producing a gas stream through said structured belt, the fibrous web, and said supporting belt.

11. The apparatus of claim 10, wherein said gas stream flows firstly through said structured belt, then through the fibrous web, and finally through said supporting belt.

12. The apparatus of claim 10, wherein said gas stream generator comprises at least one of an air stream generator and a steam stream generator.

13. The apparatus of claim 10, wherein said pressing section includes a side adjacent to said supporting belt, said gas stream generator comprises a rotating suction roll having a suction zone and delimiting said pressing section on said side.

14. The apparatus of claim 10, wherein said pressing section includes a side adjacent to said supporting belt, at least in part said gas stream generator comprises one of a flat suction box and a curved suction box, said one of a flat suction box and a curved suction box delimiting said pressing section on said side.

15. The apparatus of claim 10, wherein said circulating permeable structured belt has a side, said gas stream generator comprises a positive pressure hood arranged on said side.

16. The apparatus of claim 1, wherein said structured belt is a structured fabric.

17. The apparatus of claim 1, wherein said structured belt is a through air drying fabric.

18. The apparatus of claim 1, further comprising a fibrous stock suspension, a sheet forming device, and a vacuum device, said fibrous stock suspension for forming the fibrous web, said sheet forming device having a suction device, said structured belt having a structure, said suction device sucking said fibrous stock suspension into said structure of said structured belt by said vacuum device.

19. The apparatus of claim 1, wherein said supporting belt is a dewatering belt.

20. The apparatus of claim 1, wherein said structured belt includes a plurality of relatively depressed regions and a plurality of relatively elevated regions, said plurality of relatively depressed regions and said plurality of relatively elevated regions of said structured belt are formed and arranged relative to one another in such a way that at most 35% of said structured belt is pressed in said press nip.

21. The apparatus of claim 1, wherein said structured belt includes a plurality of relatively depressed regions and a plurality of relatively elevated regions, said plurality of relatively depressed regions and said plurality of relatively elevated regions of said structured belt are formed and arranged relative to one another in such a way that at most 25% of said structured belt is pressed in said press nip.

22. The apparatus of claim 1, wherein said press nip is a shoe press nip.

23. The apparatus of claim 1, wherein said Yankee cylinder is associated with only one said at least one doctor, said doctor firstly removing a part of said coating material, said doctor secondly creping and lifting off the fibrous web from said surface of said Yankee cylinder.

24. The apparatus of claim 1, wherein said Yankee cylinder is associated with a first doctor and a second doctor, said first doctor for creping and lifting off the fibrous web from said surface of said Yankee cylinder, said second doctor for removing at least a part of said coating material.

25. The apparatus of claim 1, wherein a mating roll forms said press nip with said Yankee cylinder, wherein said air knife, in a region in which said structured belt runs off said mating roll, acts on an outlet pocket between said structured belt and said mating roll.

26. The apparatus of claim 1, further comprising a reeler, wherein the fibrous web removed from said Yankee cylinder again is fed to said reeler.

* * * * *